US007886709B2

(12) United States Patent
Riedel et al.

(10) Patent No.: US 7,886,709 B2
(45) Date of Patent: Feb. 15, 2011

(54) SPRING START FOR A VEHICLE ENGINE

(75) Inventors: Paulo A Riedel, Rochester Hills, MI (US); Leandro D Nadai, Novi, MI (US); Roberto De Paula, New Hudson, MI (US); David J Torres, Novi, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 12/474,687

(22) Filed: May 29, 2009

(65) Prior Publication Data

US 2010/0300393 A1 Dec. 2, 2010

(51) Int. Cl.
*F02N 5/02* (2006.01)

(52) U.S. Cl. ..... 123/185.14

(58) Field of Classification Search ..... 123/185.14
See application file for complete search history.

(56) References Cited

U.S. PATENT DOCUMENTS

| | | | | |
|---|---|---|---|---|
| 6,647,942 | B2 * | 11/2003 | Poehlman et al. | 123/185.14 |
| 6,971,359 | B2 * | 12/2005 | Tohyama | 123/185.3 |
| 7,069,896 | B2 * | 7/2006 | Tsunoda et al. | 123/185.3 |
| 7,140,341 | B2 * | 11/2006 | Dahlberg | 123/185.3 |
| 7,473,204 | B2 | 1/2009 | Costello | |
| 7,496,435 | B2 | 2/2009 | Iwatsuki et al. | |
| 7,525,287 | B2 | 4/2009 | Miyashita et al. | |
| 2003/0213455 | A1 * | 11/2003 | Tohyama | 123/185.3 |
| 2004/0123828 | A1 * | 7/2004 | Sing et al. | 123/185.14 |
| 2004/0177823 | A1 * | 9/2004 | Saito | 123/185.14 |
| 2005/0252477 | A1 * | 11/2005 | Schriever et al. | 123/185.14 |
| 2006/0027201 | A1 * | 2/2006 | Ono | 123/179.25 |
| 2006/0231055 | A1 * | 10/2006 | Dahlberg | 123/185.3 |
| 2008/0115756 | A1 * | 5/2008 | Sugishita et al. | 123/185.14 |
| 2008/0223328 | A1 * | 9/2008 | Ono | 123/185.14 |
| 2008/0283017 | A1 * | 11/2008 | Sugishita et al. | 123/185.14 |
| 2009/0062052 | A1 | 3/2009 | Kim | |
| 2009/0114465 | A1 | 5/2009 | Costello | |
| 2009/0232674 | A1 * | 9/2009 | Fiorenza et al. | 417/364 |
| 2010/0155160 | A1 * | 6/2010 | Burchett et al. | 180/65.21 |

* cited by examiner

*Primary Examiner*—Hai H Huynh
(74) *Attorney, Agent, or Firm*—Quinn Law Group, PLLC

(57) ABSTRACT

A spring assembly is mounted on a crankshaft for a vehicle. A selector mechanism for the spring assembly selectively connects the spring assembly to the crankshaft. The selector mechanism is engaged in a first position to connect the spring to the crankshaft when the engine is shut-off such that the crankshaft winds the spring as it rotates. The selector mechanism is then engaged in a second position such that the spring applies a rotational force to re-start the engine. A method for braking the engine includes engaging the crankshaft with the torsion spring and winding the torsion spring with rotation of the crankshaft until the tension within the torsion spring is greater than the force applied to the crankshaft.

9 Claims, 2 Drawing Sheets

SPRING START FOR A VEHICLE ENGINE

TECHNICAL FIELD

The present invention relates generally to a hybrid vehicle, and more specifically to an arrangement to start an engine for a hybrid vehicle.

BACKGROUND OF THE INVENTION

Vehicles having traditional transmissions typically utilize starter motors, also referred to as a starter, to start the vehicle engine. However, vehicles having hybrid transmissions frequently stop the engine to enhance fuel economy. Vehicles with hybrid transmissions, therefore, require the vehicle engine be restarted more frequently. This increases the duty cycle on the starter. As a result, a more expensive and durable starter must be utilized to meet the requirements of vehicles with a hybrid transmission.

SUMMARY OF THE INVENTION

A vehicle with a hybrid transmission having an arrangement for restarting an engine while reducing load on a starter and battery is desired.

A vehicle includes an engine with a crankshaft extending from the engine. A spring assembly is mounted on the crankshaft. The spring assembly includes a spring. A selector mechanism for the spring assembly selectively connects the spring to the crankshaft. The selector mechanism is engaged in a first position to connect a first end of the spring to the crankshaft when the engine is shut-off such that the crankshaft winds the spring as it rotates. The selector mechanism is then engaged in a second position to connect a second opposing end of the spring to the crankshaft, such that the spring applies a rotational force to the crankshaft to re-start the engine.

A method for starting the engine includes rotating the crankshaft with tension from the torsion spring and disengaging the torsion spring from the crankshaft when the tension within the torsion spring reaches zero.

A method for braking the engine includes moving the selector mechanism to selectively rotatably engage the torsion spring with the crankshaft and winding the torsion spring with rotation of the crankshaft until the tension within the torsion spring is greater than the force applied to the crankshaft.

The above features and advantages, and other features and advantages of the present invention will be readily apparent from the following detailed description of the preferred embodiments and best modes for carrying out the present invention when taken in connection with the accompanying drawings.

DESCRIPTION OF THE PREFERRED EMBODIMENTS

Figure 1:
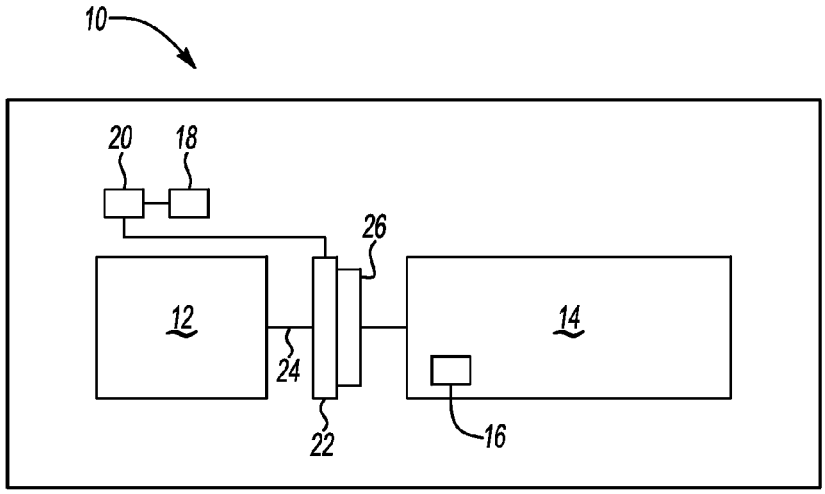
FIG. 1 is a schematic top view illustration of a vehicle having a hybrid transmission and an engine with a starter spring.
Figure 2:
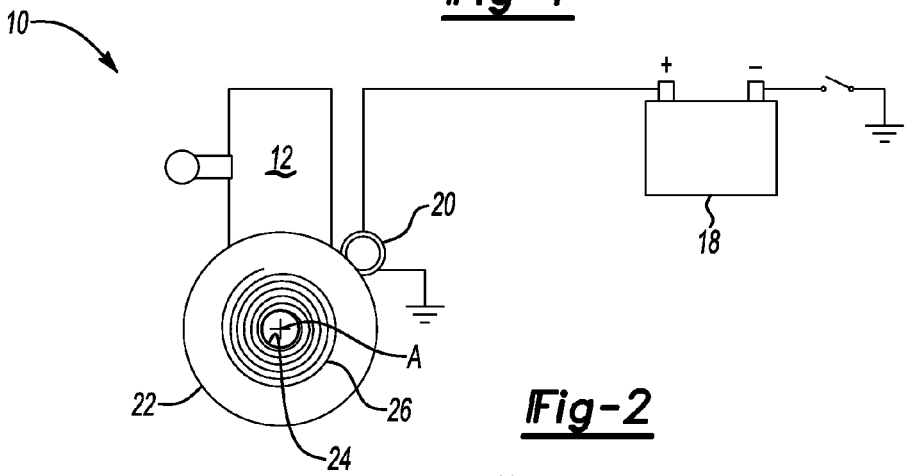
FIG. 2 is a schematic side illustration of the vehicle having the hybrid transmission and the engine with the starter spring of FIG. 1.

Referring to the Figures, wherein like reference numbers refer to the same or similar components throughout the several views, FIGS. 1 and 2 illustrate schematic views of an exemplary vehicle 10, having an engine 12 and a hybrid transmission 14. The hybrid transmission 14 has at least one motor/generator 16 located therein to assist the vehicle engine 12 and store power as is known for hybrid transmissions. A battery 18 and a starter 20 are connected to the engine 12. A flywheel 22 may also be connected to a crankshaft 24 of the engine 12, as is illustrated in FIG. 1. To start the engine 12, the battery 18 sends power to the starter 20. The starter 20 applies a rotational force to the flywheel 22, which in turn rotates the crankshaft 24. The flywheel 22 and the crankshaft 24 rotate about a common axis A. The spring assembly 26 includes a spring 28 (shown in FIGS. 3-5). The spring 28 is preferably a torsion spring, as shown. The spring assembly 26 is mounted to the crankshaft 24.

Frequently, when the vehicle 10 is running the motor/generator 16 provides sufficient power to operate the vehicle 10. In this instance the engine 12 is shut off and the vehicle is operated in electric vehicle mode. One example of when this occurs is when the vehicle 10 is coming to a stop. As the engine 12 slows to a stop, momentum from the engine 12 is still continuing to rotate the crankshaft 24, albeit more slowly. The spring assembly 26 is moved to a first engaged position (shown in FIG. 3) with the crankshaft 24. In the first engaged position the rotation of the crankshaft 24 winds the torsion spring 28. When the vehicle 10 requires more power and the transmission is no longer sufficient, the engine 12 is restarted. Prior to the engine 12 restarting, the spring assembly 26 is moved to a second engaged position (shown in FIG. 4) and the tension within the torsion spring 28 is transferred to the crankshaft 24 to start the engine 12. After the tension within the spring 24 has been used to start the engine 12 the spring assembly 26 is moved to the disengaged position (shown in FIG. 5).

Figure 3:
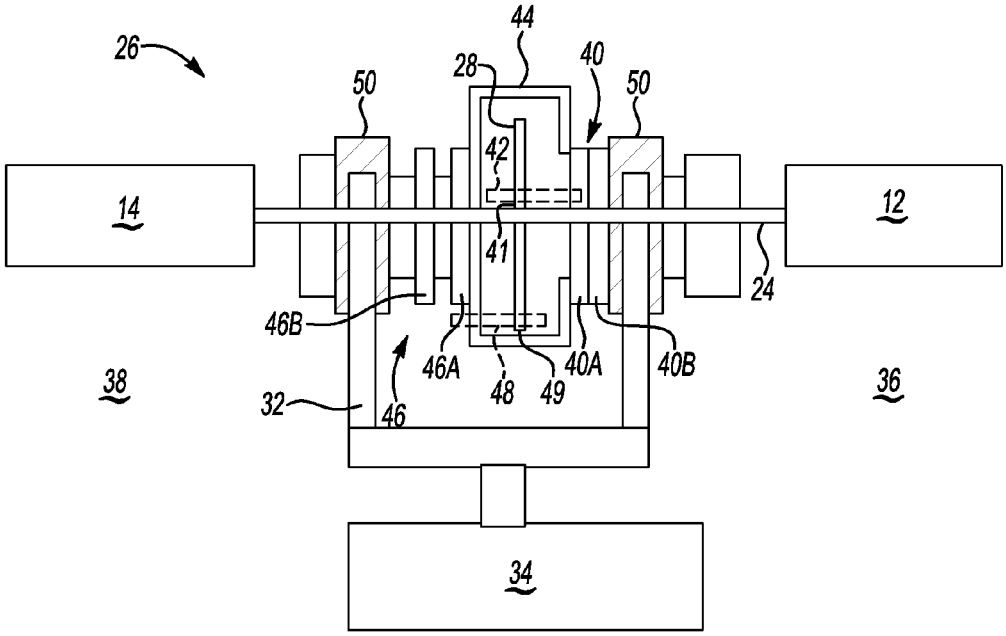
FIG. 3 is a schematic partially cross-sectional side illustration of the vehicle having the hybrid transmission and the engine of FIGS. 1 and 2 with the starter spring in a first engaged position.
Figure 4:
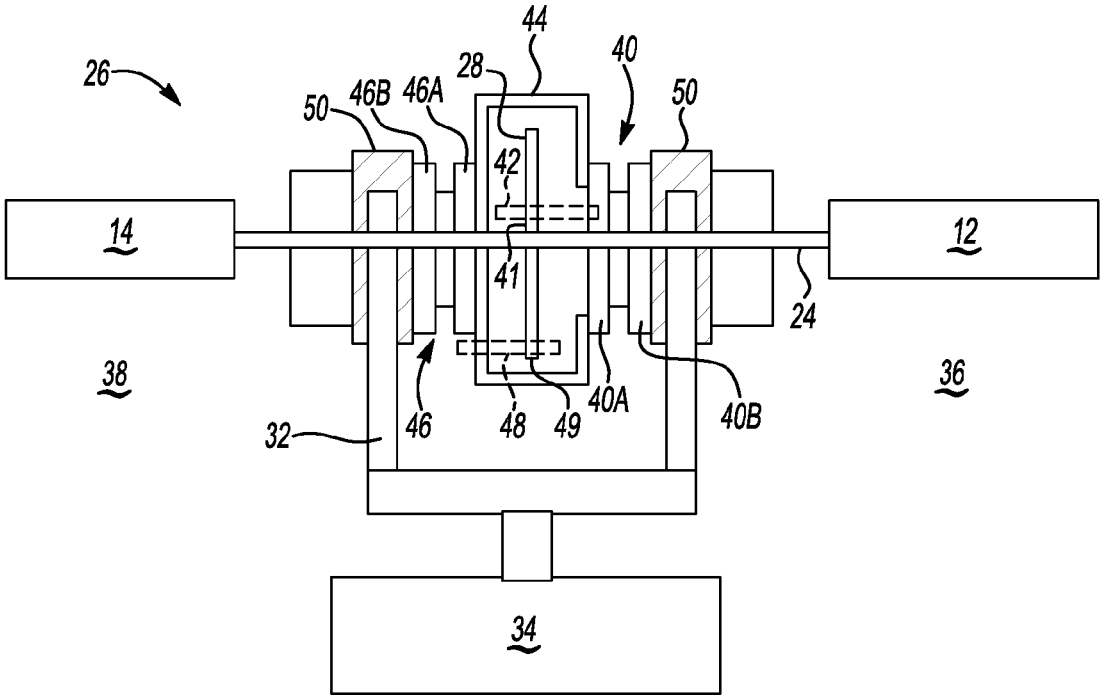
FIG. 4 is a schematic partially cross-sectional side illustration of the vehicle having the hybrid transmission and the engine of FIGS. 1 and 2 with the starter spring in a second engaged position.
Figure 5:
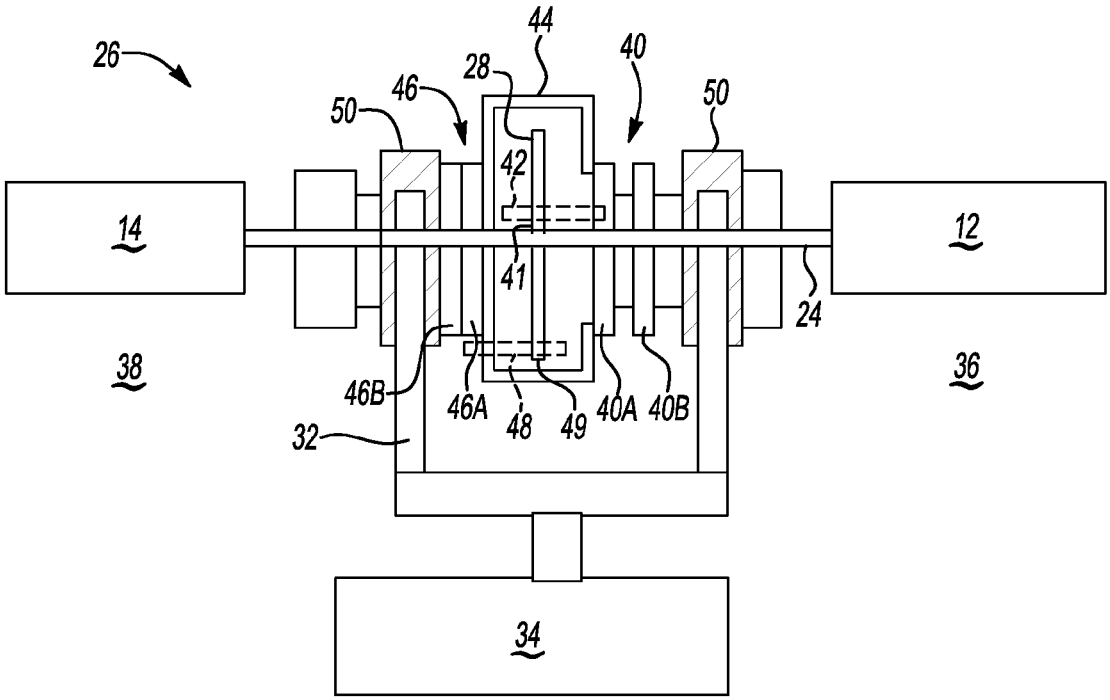
FIG. 5 is a schematic partially cross-sectional side illustration of the vehicle having the hybrid transmission and the engine of FIGS. 1 and 2 with the starter spring in a disengaged position.

Referring to FIGS. 3-5, the connection between the spring assembly 26 and the crankshaft 24 is shown in greater detail. The torsion spring 28 is selectively connected to the crankshaft 24 with a selector mechanism 32. The spring assembly 26 also includes an electric actuator 34 to control the selector mechanism 32. The spring assembly 26 is rotatably mounted about the crankshaft 24, such that the spring 28 and a spring housing 44 may rotate relative to the crankshaft 24.

In FIG. 3, the spring assembly 26 is shown in a first engaged position with the crankshaft 24. In the first engaged position, the selector mechanism 32 has been axially moved to an engine side 36 of the spring assembly 26. Moving the selector mechanism 32 to the engine side 36 of the spring assembly 26 engages a first clutch 40 and a second clutch 46 located on a transmission side 38 of the spring assembly 26 is disengaged. The torsion spring 28 is connected at a first end 41 to a first portion 40A of the first clutch 40 with a first fastener 42. The first clutch 40 has a first portion 40A which is secured to the spring 48 and rotates therewith. The first clutch 40 also has a second portion 40B which is mounted to the crankshaft 24 and rotates therewith. When the first clutch 40 is engaged (first portion 40A is in contact with second portion 40B) the torsion spring 28 is rotatably connected to the crankshaft 24. Torque is transferred from the crankshaft 24 through the first clutch 40 to wind the torsion spring 28. The selector mechanism 32 is moveable to actuate the first clutch 40 and the second clutch 46, but is not rotatably connected to the crankshaft 24. The selector mechanism 32 may include bushings 50 to accommodate for the relative rotation between the selector mechanism 32 and the first clutch 40 and the second clutch 46.

At the time when the engine 12 is shut off, the selector mechanism 32 moves the first portion 40A of the first clutch 40 to contact the second portion 40B of the first clutch 40. The selector mechanism 32 engages the clutch 40 placing the spring assembly 26 in a first engaged position, which connects the torsion spring 28 with the crankshaft 24.

As the engine 12 slows to a stop, momentum from the engine 12 is still continuing to rotate the crankshaft 24, albeit more slowly. Since the selector mechanism 32 has engaged the torsion spring 28 with the crankshaft 24, the rotation of the crankshaft 24 winds the torsion spring 28. At this time, the force applied to the crankshaft 24 due to the increased tension of winding the spring 28 assists in braking the engine 12 more quickly. The engine 12 will come to a stop when the tension within the torsion spring 28 is equal to the force applied to the crankshaft by the engine 12.

While the vehicle 10 continues to operate in the electric vehicle mode the engine 12 is shut off and the torsion spring 28 is under tension resulting from the rotation of the crankshaft 24 as the engine 12 stopped. As the vehicle 10 continues to run, the engine 12 may again be required to power the vehicle 10. Prior to the engine 12 being re-started, the electric actuator 34 moves the selector mechanism 32 from the first engaged position on the engine side 36 to a second engaged position on the transmission side 38. The first clutch 40 disengages and a second clutch 46 engages. That is, the first portion 40A is no longer in contact with the second portion 40B of the first clutch and a first portion 46A is moved into contact with a second portion 46B of the second clutch 46.

Referring to FIG. 4, the spring assembly 26 is in the second engaged position with the selector mechanism 32 located on a transmission side 38 of the spring assembly 26. The torsion spring 28 is connected to the spring housing 44 at a second end with a second fastener 48. The spring housing 44 and the second portion 46B of the second clutch 46 are secured to one another. When the second clutch 46 is engaged, the first portion 46A is moved to contact the second portion 46B of the second clutch 46. The tension from the torsion spring 28 rotates the spring housing 44 which in turn drives the second clutch 46. As noted above, the spring housing 46 may rotate relative to the crankshaft 24. The second portion 46 of the second clutch 46 is mounted to the crankshaft 24. Therefore, the torsion spring 28 is still connected in a manner to drive the crankshaft 24 when the second clutch 46 is engaged. The engine 12 is restarted and the tension within the torsion spring 28 is transferred through the second clutch 46 to the crankshaft 24 to start the engine 12. After the tension within the spring 24 has been used to start the engine 12 the selector mechanism 32 is moved to the disengaged position, shown in FIG. 5.

The size and capacity of the spring 28 will determine the amount of tension within the spring 28 available to start the engine 12. The engine 12 may, thus, be started without requiring use of the starter 20 and the battery 18. The size and durability of the starter 20 may be reduced due to the decreased load cycle. Utilizing the spring assembly 26 to re-start the engine 12 will reduce the load and duty cycle require by the battery 18, as well.

Alternatively, the spring 26 may be determined to have a size and capacity that will assist the starter 20 in restarting the engine 12 rather than providing all the power that is required to restart the engine 12. The size and durability of the starter 20 and the battery 18 may still be reduced due to the decreased load cycle.

In FIG. 5 the spring assembly 26 is illustrated in a disengaged position. When the spring assembly 26 is in the disengaged position the crankshaft 24 and the spring assembly 26 are rotationally disconnected from one another. Rotation of the crankshaft does not wind the torsion spring 28. The first clutch 40 and the second clutch 46 are both disengaged. That is, the first portion 40A is not in contact with the second portion 40B of the first clutch 40. The first portion 40A and the second portion 40B may rotate relative to one another. Likewise, the first portion 46A is not in contact with the second portion 46B of the second clutch 46, and they may rotate relative to one another. The first portions 40A and 46A will freely rotate with the spring 28 and the spring housing 44. The second portions 40B and 46B will rotate with the crankshaft 24.

The electric actuator 34 axially moves the selector mechanism 32 along the crankshaft 24 to a disengaged position after the tension within the spring 28 returns to zero. Disengaging the selector mechanism 32 allows the spring 28 to rotate relative to the flywheel 22 and the crankshaft 24 during operation of the engine 12 without winding the spring 28, i.e. placing tension on, the spring 28.

The selector mechanism 28 may be any device allowing the spring 24 to be connected and disconnected from the crankshaft 24. One skilled in the art would be able to determine an appropriate type of selector mechanism 28 to engage and disengaged the spring 28 from the crankshaft 24.

Due to the amount of power required to start then engine 12 at a cold start, i.e. when the vehicle has not been running, the spring 28 may be moved to the disengaged position or may assist the starter 18.

While the best modes for carrying out the invention have been described in detail, those familiar with the art to which this invention relates will recognize various alternative designs and embodiments for practicing the invention within the scope of the appended claims.

The invention claimed is:

1. A vehicle comprising:

an engine;

a crankshaft extending from the engine;

a spring assembly selectively connected for rotation with the crankshaft, wherein the spring assembly includes a torsion spring;

a selector mechanism for the spring assembly, wherein the selector mechanism selectively connects the spring to the crankshaft;

wherein the selector mechanism is movable to a first position to connect a first end the spring to the crankshaft when the engine is shut-off such that the crankshaft winds the spring as it rotates; and wherein the selector mechanism is moveable to a second position to connect a second opposing end of the spring to the crankshaft such that the spring applies a rotational force to re-start the engine.

2. The vehicle of claim 1, wherein the selector mechanism is in a disengaged position after the engine is started.

3. The vehicle of claim 1, further comprising a transmission having at least one motor/generator and connected to the engine.

4. The vehicle of claim 1, further comprising:

a flywheel mounted on the crankshaft;

a starter connected to the flywheel; and a battery to supply power to the starter, wherein the starter rotates the flywheel to assist the spring assembly in re-starting the engine.

5. The vehicle of claim 4, wherein the stationary object is an engine block.

6. The vehicle of claim 1, wherein the spring is a torsion spring.

7. The vehicle of claim 1, wherein the spring assembly further includes an electric actuator to control the position of the selector mechanism.

8. A method for starting a vehicle engine, comprising:

rotating a crankshaft of the engine with tension from a torsion spring to start the engine;

disengaging the torsion spring from the crankshaft when the tension within the torsion spring reaches zero; applying power to a starter with a battery; and rotating via the starter a flywheel connected to the crankshaft to assist the torsion spring in rotating the crankshaft prior to disengaging the torsion spring.

9. The method of claim 8, wherein rotating the crankshaft with tension from a torsion spring further includes:

prior to rotating the crankshaft with tension from the torsion spring, moving a selector mechanism to a first engaged position to engage the torsion spring and the crankshaft for common rotation;

winding the torsion spring with rotation of the crankshaft; and moving the selector mechanism to a second engaged position to permit rotating the crankshaft with the tension from the torsion spring.

* * * * *